United States Patent [19]

Sekiguchi et al.

[11] Patent Number: 4,469,507

[45] Date of Patent: Sep. 4, 1984

[54] PRODUCTION PROCESS OF FERROMAGNETIC IRON POWDER

[75] Inventors: Haruo Sekiguchi, Chigasaki; Kazufuyu Sudoh, Zushi; Sadao Kobayashi; Nobuhiro Fukuda, both of Yokohama, all of Japan

[73] Assignee: Mitsui Toatsu Chemicals, Incorporated, Tokyo, Japan

[21] Appl. No.: 460,638

[22] Filed: Jan. 24, 1983

[51] Int. Cl.[3] ..... C22C 1/04

[52] U.S. Cl. ..... 75/0.5 AA; 75/0.5 BA; 148/105

[58] Field of Search ..... 75/0.5 BA, 0.5 AA; 148/105; 252/62.56

[56] References Cited

U.S. PATENT DOCUMENTS 4,165,232 8/1979 Jaeckl et al. ..... 75/0.5 BA
4,290,799 9/1981 Schroeder et al. ..... 75/0.5 AA

FOREIGN PATENT DOCUMENTS 42832 12/1979 Japan ..... 75/0.5 AA

*Primary Examiner*—L. Dewayne Rutledge
*Assistant Examiner*—Debbie Yee
*Attorney, Agent, or Firm*—Fisher, Christen & Sabol

[57] ABSTRACT

Disclosed herein is a process for producing ferromagnetic iron powder, which process comprises adding and mixing zinc borate with $\alpha$-FeOOH or $\alpha$-$Fe_2O_3$ without dissolving the former, heating the thus-obtained mixture to 350° C. or higher in a non-reducing atmosphere and then reducing the thus-heated mixture.

7 Claims, 2 Drawing Figures

PRODUCTION PROCESS OF FERROMAGNETIC IRON POWDER

BACKGROUND OF THE INVENTION (1) Field of the Invention

This invention relates to a process for producing ferromagnetic iron powder which has utility for high-density magnetic recording media such as magnetic tapes, magnetic drums and magnetic discs.

(2) Description of the Prior Art

It has heretofore been known that ferromagnetic iron powder can be produced by heating and reducing an oxyhydroxide or oxide such as acicular $\alpha$-FeOOH or $\alpha$-$Fe_2O_3$(hereinafter abbreviated as "acicular goethite or the like"). However, such a conventional process is inevitably accompanied by breakup, fragmentation and sintering of the raw material, goethite or the like upon heating and reducing same. As an improvement to the above-described prior art process, it has been proposed in Japanese patent Publication No. 42832/1979 to obtain ferromagnetic metal powder by dipping its corresponding oxide or oxyhydroxide in an aqueous solution containing boron oxide or a borate dissolved therein and then heating and reducing the thus-dipped oxide or oxyhydroxide.

When the latter process is followed, a great deal of energy is required because a large volume of water, which contains boron oxide or borate, has to be removed by evaporation. Furthermore, the boron oxide or borate dissolved in water tends to move together with water toward the evaporation interface upon driving off the solvent and the concentration distribution of boron oxide or the borate within the resulting powder becomes unavoidably uneven, leading to another disadvantage that the powder has to be heated and reduced while being of uneven concentration distribution. As a result, the magnetic properties of the thus-obtained powder deteriorate.

The above-described phenomenon that boron oxide or the borate moves to the evaporation interface upon the removal of the solvent by evaporation will be described in further detail. The concentration of boron oxide or the borate in a surface layer increases due to, for example, the movement of a filter layer to the surface phase, the movement of filter cake onto the surfaces of lumps or the like, thereby deleteriously affecting the uniformity of the ferromagnetic iron powder to be obtained.

SUMMARY OF THE INVENTION

An object of this invention is to provide ferromagnetic iron powder having utility for high-density magnetic recording media such as magnetic tapes, magnetic drums, magnetic discs and the like.

Another object of this invention is to provide ferromagnetic iron powder having uniform quality and such magnetic properties as high coersive force (Hc).

The above objects have been achieved by a process for producing ferromagnetic iron powder by heating a metal oxyhydroxide or oxide containing iron as its principal metallic element in a reducing atmosphere so as to reduce said oxyhydroxide or oxide, which process comprises the following consecutive steps:

mixing said oxyhydroxide or oxide with zinc borate at a B/Fe atomic weight ratio of 0.05/100–5/100 without dissolving said borate, so that said borate is dispersed in said oxyhydroxide or oxide;

heating the thus-obtained mixture to 350° C. or higher in a non-reducing atmosphere; and heating and reducing the thus-heated mixture while keeping same in contact with hydrogen gas.

DESCRIPTION OF PREFERRED EMBODIMENTS

Figure 1:
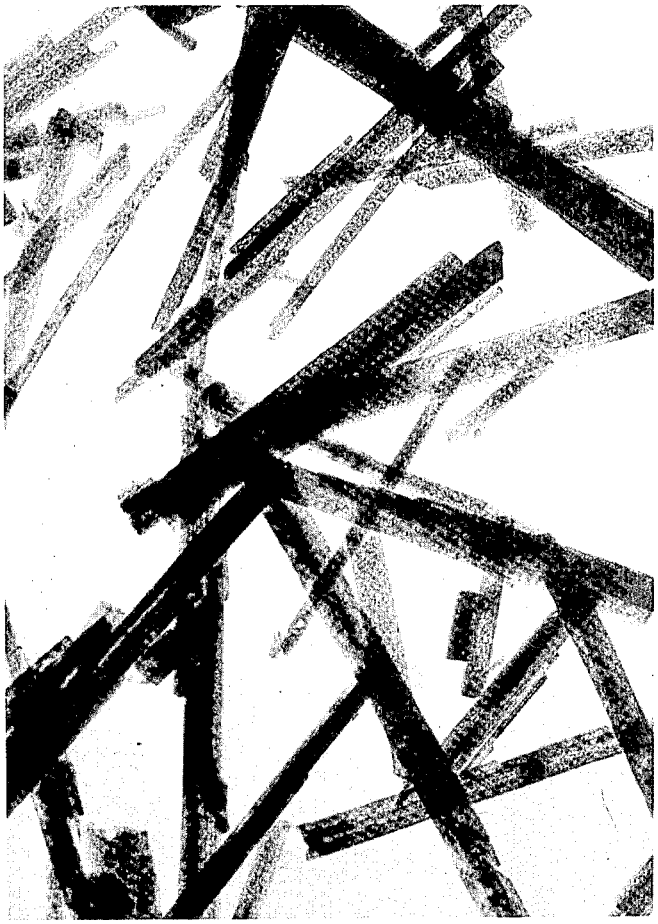
FIG. 1 is a transmission electron micrograph (×100,000) of $\alpha$-FeOOH treated with zinc borate and then subjected to a heating step.

In the practice of the process according to this invention, it is possible to use a metal oxyhydroxide or oxide containing iron as its principal metallic element and obtained in a manner commonly known in the art without any further treatment or processing. Accordingly, a mechanical mixing method may be applied to mix and disperse, for example, acicular goethite or the like and zinc borate, using such an ordinary mixer as will be described later in this specification.

Thus, zinc borate is mixed with and dispersed in acicular goethite or the like without need for dissolving the former in a solvent or the like and, in some instances, by mixing them together in solid forms. It is however feasible to employ a small amount of a dispersing medium, e.g., water or the like since the present invention makes use of zinc borate, the solubility of which being less than 0.1 wt.% at 20° C. in water. When using a dispersing medium as mentioned above, it is preferable to employ as the dispersing medium such a medium that does not dissolve zinc borate or has extremely low dissolving power of less than 1 wt.% for it because, although the dispersing medium may be separated from zinc borate by filtration or evaporation as mentioned above, zinc borate may move together with the dispersing medium to the filtrate side and/or the concentration distribution of zinc borate may be rendered uneven upon causing the dispersing medium to evaporate if the dispersing medium should have high dissolving power.

It should however be borne in mind that the effects of the present invention will not be adversely affected by the co-presence of other elements such as Si, P and Cr and/or the same elements in other forms such as Al, Ni, Mn and Cu compounds other than zinc borate. Zinc borate may be added at a boron/iron atomic weight ratio (hereinafter abbreviated as "B/Fe ratio") of 0.05/100–5/100, and preferably 0.2/100–2/100. No distinct effects can be brought about when the B/Fe ratio is less than 0.05/100. On the other hand, at any B/Fe ratios higher than 5/100, iron is diluted by zinc borate, resulting in deteriorated magnetic properties. Use of such a high B/Fe ratio is also inconvenient because it requires an excessively long time to complete the subsequent reducing step. Although the ferromagnetic iron powder obtained in accordance with this invention is diluted due to the incorporation of boron and other elements therein, it consists principally of iron and contains iron, preferably, at a proportion of 90 wt.% or more.

The mixing of the metal oxyhydroxide or oxide with zinc borate or, in some instances, their mixing and dispersion in the presence of a dispersing medium may be effected mechanically, for example, using a mixer such as a mixing blender, e.g., ribbon blender, mix-muller, roll mixer, or ball mill. When mixing and dispersing them in, for example, a ribbon blender, the mixing and dispersing operation can be effected to a sufficient extent generally in 5 minutes to 10 hours, and more generally in 5 minutes to 6 hours or so at room temperature. It is also feasible in the present invention to drive off the dispersing medium in the course of such a mixing and dispersing operation. Here, the mixing and dispersing operation may be carried out under reduced pressures and/or at elevated temperatures of about 100° C.

The acicular goethite or the like containing zinc borate mixed and dispersed therein is then heated for 30 minutes to 4 hours, at temperatures of 350° C. and higher, preferably at 350–500° C. and in a non-reducing atmosphere, for example, in air or nitrogen gas. Owing to this heating operation, the oxyhydroxide ($\alpha$-FeOOH) is converted to the oxide ($\alpha$-$Fe_2O_3$) and, at the same time, zinc borate is rendered compatible with the acicular goethite or the like. In other words, it is gathered that the deposition of zinc borate into pores present in particle surfaces of the goethite is carried out efficiently by mixing the acicular goethite or the like with zinc borate and then heating the resultant mixture to 350° C. or higher. Although it has not yet been elucidated why such an efficient deposition takes place, it has been recognized, as shown in the accompanying drawings, that the number of pores in an oxide decreases to a significant extent when heated in accordance with the present invention.

The process next move to the reducing step, in which $H_2$ gas or a gaseous mixture containing $H_2$ gas is caused to act on the goethite or the like at 200°–450° C., and preferably at 350°–400° C. A suitable supply rate of $H_2$ gas to the goethite or the like may be in the range of 0.1–100 Nl/gr-Fe/hr, preferably 2–50 Nl/gr-Fe/hr as expressed in terms of gas space velocity (GHSV). Below the lower limit, the progress of the reaction is too slow to actually carry it out. On the other hand, any supply rates of $H_2$ gas greater than the upper limit result in an increment in pressure loss within the reactor and are thus not suitable for the control of the reaction.

Furthermore, outside the above-described reaction temperature range, more specifically, at temperatures lower than the lower limit of the reaction temperature range, the reaction proceeds at a slow speed and takes a longer time to bring the reaction to completion. Use of such low reaction temperatures is thus not practical. On the other hand, use of a reaction temperature higher than the above-described reaction temperature range tends to induce the sintering of acicular goethite or the like.

One of merits of the present invention is that this has, made it possible to lower the reducing temperature. According to prior art processes, it was difficult to obtain satisfactory magnetic properties when the reducing temperature was lowered. However, when the present invention is followed, satisfactory magnetic properties are observed even if the reducing temperature is lowered to 350° C.–400° C. A high power electron microscopic observation accordingly indicates that iron powder obtained in accordance with this invention still retains almost completely the shape of goethite or the like, which was used as the starting material, and is substantially free of such phenomena as particle breakup and fragmentation and intergranular sintering. Superb magnetic properties of the thus-obtained iron powder are readily realized, because, taking — by way of illustration — coersive force (Hc) which may vary to some extent in accordance with the sizes and length/-width ratios of particles, the Hc value of iron powder obtained by reducing goethite or the like at 375° C. in the presence of zinc borate is 1340 (Oe), namely, this value is extremely high. Such superb magnetic properties meet the property requirements for materials to be used in the fabrication of high-density magnetic recording media. This has been substantiated by the magnetic properties of the substance after it has been formed into magnetic tapes. Accordingly, ferromagnetic iron powder according to this invention has an extremely high practical value.

The present invention will hereinafter be described more specifically in the following Examples.

EXAMPLE 1

The B/Fe ratio was set at 0.5/100 in the present example.

Added to 100 gr of acicular $\alpha$-FeOOH were 3 gr of zinc borate (calculated as $2ZnO.3B_2O_3.3.5H_2O$). The thus-proportioned mixture was mixed for 30 minutes in a mixing blender so that zinc borate was dispersed in $\alpha$-FeOOH. The thus-prepared mixture was thereafter placed in a heating furnace, where it was heated at 450±5° C., for 2 hours and in an atmosphere of air. Then, it was allowed to cool and drawn out of the furnace. A high power transmission electron microscopic observation confirmed the occurrence of $\alpha$-$Fe_2O_3$ bearing few pores (see, FIG. 1).

Then, 50 gr of the $\alpha$-$Fe_2O_3$ obtained in the above heating step was charged in a reactor formed of a stainless steel tube of 38 mm in inner diameter and provided with a reaction gas preheater. $H_2$ gas was charged at a supply rate of GHSV=20Nl-$H_2$/gr-Fe/hr and the iron oxide was subjected to reduction at 375° C. for 7 hours. After completion of the reduction, the interior gas was replaced by $N_2$ gas and the reaction product was allowed to cool there. The thus-reduced iron powder was taken out of the reactor and then dipped in toluene. A portion of the iron powder was spread on an enameled plate, thereby allowing the toluene to evaporate. The iron powder (hereinafter called "wind-dried iron powder"), from which toluene had been driven off by evaporation, was subjected to measurement to determine its magnetic properties. The magnetic measurements were carried out in a magnetic field of 3.7 KOe at the maximum, using a dc-type magnetic hysteresis analyzer. Its coersive force (Hc), saturated magnetization ($\sigma s$) and squareness ratio ($\sigma r/\sigma s$) were respectively 1340 Oe, 171 emu/gr and 0.60, thereby showing that the iron powder has very good magnetic properties.

COMPARATIVE EXAMPLE 1

Figure 2:
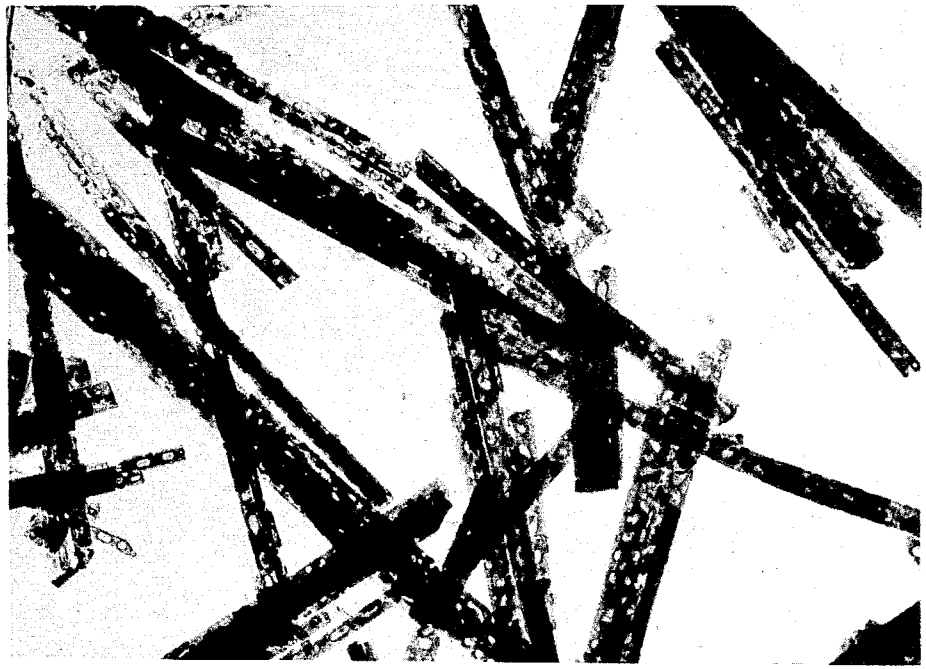
FIG. 2 is a transmission electron micrograph (×100,000) of $\alpha$-FeOOH subjected to a heating step without pretreating same with zinc borate.

$\alpha$-FeOOH was subjected to a heat-treatment under the same conditions as in Example 1 except that no zinc borate was added. A similar transmission electron microscopic observation showed $\alpha$-$Fe_2O_3$ bearing less pores (see, FIG. 2). The thus-obtained $\alpha$-$Fe_2O_3$, to which zinc borate had not been added, was reduced to iron under the same reducing conditions as in Example 1 and the magnetic properties of the resultant iron powder were found to be Hc=540 Oe; $\sigma s$=176 emu/gr; and $\sigma r/\sigma s$=0.31. Thus, its magnetic properties had greatly decreased in comparison with those of iron powder obtained in accordance with this invention. As a result of a high power electron microscopic observation on the iron powder obtained in each of Example 1 and Comparative Example 1, it was found that the iron powder according to this invention still retained acicular crystallinity even after being reduced into iron powder whereas the iron powder obtained in Comparative Example 1, which was given for the sake of comparison, was in a sintered state and no longer retained the acicular crystallinity of its starting α-FeOOH. Incidentally, the measurements of the above magnetic properties were effected in a magnetic field of 3.7 KOe at the maximum, using a dc-type magnetic hysteresis analyzer.

COMPARATIVE EXAMPLE 2

Added to 200 gr of acicular α-FeOOH used in Example 1 were 625 gr of an aqueous solution of 1 wt.% of ammonium borate, said mixture was mixed for 30 minutes in a mixing blender (calculated as B/F=0.5/100). The thus-prepared mixture was spread in a layer about 3 cm thick in a heating furnace and heated for 2 hours at 500° C. in the same manner as described in Example 1. It was then allcwed to cool and drawn out. Where the B/F conten ratio of $\alpha$-$Fe_2O_3$ present in the upper part of the above layer in a heating furnace was calculated as 1, that of lower part was calculated as 0.71. Then the resulting heated mixture was reduced and its magnetic properties were measured in the same manner as described in Example 1. The magnetic properties of the resulting iron powder were Hc=1040–1210 Oe ; $\sigma s$=150–170 emu/gr ; and $\sigma r/\sigma s$=0.45–0.52, and it is recognized that it had scattered magnetic properties according to its position in the heating furnace. Namely, where water soluble borates are added to acicular goethite or the like, scattering of magnetic properties occurs and the resulting iron powder is unsuitable for use in magnetic recording media.

EXAMPLE 2

In the present example, the heating conditions were set at 400° C. and 2 hours while employing a B/Fe ratio of 0.2/100. Other conditions were identical to those used in Example 1. Namely, 1.2 gr of zinc borate was added to 100 gr of acicular α-FeOOH and the thus-proportioned mixture was mixed for 30 minutes in a mixing blender, thereby dispersing zinc borate in α-FeOOH. The resultant mixture was thereafter placed in a heating furnace, where it was heated at 400±5° C., for 2 hours and in an atmosphere of air. The thus-heated mixture was then drawn out of the furnace.

Fifty grams of the $\alpha$-$Fe_2O_3$ obtained in the above heating step were reduced in the same reactor as that used in Example 1. Measurements of magnetic properties of the thus-obtained iron powder gave Hc=1100 Oe, $\sigma s$=152 emu/gr, and $\sigma r/\sigma s$=0.54. The iron powder had properties sufficient for use as a high-density magnetic recording material.

EXAMPLE 3

The present example was carried out at a B/Fe ratio of 2/100 while setting the heating conditions at 500° C. and 2 hours. To 100 gr of acicular α-FeOOH, were added 11.2 gr of zinc borate and 1000 gr of water of low electric conductivity. The resultant aqueous mixture was mixed for 1 hour in a mix-muller. The thus-prepared mixture was thereafter suction-filtered using a "No. 5C Filter Paper" (trade name; product of Toyo Filter Paper Co., Ltd.) and the resultant solid portion of the mixture was placed in a dryer. Subsequent to drying the solid portion at 150° C. for 10 hours and driving its water content off, the resultant solid mixture was placed in a heating furnace and heated at 500±5° C., for 2 hours and in an atmosphere of air. It was then taken out of the furnace. Fifty grams of the $\alpha$-$Fe_2O_3$ obtained in the above heating step were charged in the same reactor as that used in Example 1. $H_2$ gas was charged into the reactor at a supply rate of GHSV=20 Nl-$H_2$/gr-Fe/hr so as to reduce same at 400° C. for 5 hours. Following the procedure of Example 1, the magnetic properties of iron powder, which had obtained by drying the thus-reduced product in wind, were Hc=1290 Oe, $\sigma s$=162 emu/gr and $\sigma r/\sigma s$=0.58. The iron powder obtained the present example showed very little variation in magnetic properties as days passed.

EXAMPLES 4–8

Magnetic properties of the iron powders obtained respectively by using the starting materials and reaction conditions shown in Table 1 were found as given in the same table. Reaction conditions other than those given in Table 1 were set in the same manner as in Examples 1 and 3.

TABLE 1

| Example | | 4 | 5 | 6 | 7 | 8 |
|---|---|---|---|---|---|---|
| Starting Iron Material | α-FeOOH (gr) | 100 | 100 | 100 | — | — |
| | $\alpha$-$Fe_2O_3$ (gr) | — | — | — | 100 | 100 |
| Grams of Zinc Borate (B/Fe ratio) | | 3.6 (0.6/100) | 3.6 (0.6/100) | 1.8 (0.3/100) | 1.4 (0.3/100) | 2.8 (0.6/100) |
| Co-present Compound (gr) | | Nickel nitrate (2.0) | Colloidal silica (1.0) | Colloidal silica (0.5) | Nickel borate (1.0) | Colloidal silica (1.0) |
| Dispersing Medium (gr) | | — | Water of low electric conductivity (100)* | Water of low electric conductivity (500) | — | Water of low electric conductivity (500) |
| Heating temp. (°C.) | | 400 | 450 | 500 | 400 | 500 |
| Heating time (hr) | | 3 | 2 | 1 | 4 | 1 |
| Reducing temp. (°C.) | | 420 | 375 | 400 | 350 | 450 |
| Reducing time (hr) | | 3.5 | 6 | 6 | 8 | 4 |
| Magnetic Properties | Hc (Oe) | 1280 | 1310 | 1300 | 1260 | 1170 |
| | $\sigma s$ (emu/gr) | 162 | 165 | 163 | 161 | 158 |
| | $\sigma r/\sigma s$ | 0.56 | 0.59 | 0.58 | 0.55 | 0.54 |

*Heated without removing the dispersing medium.

EXAMPLE 9

Twenty-five grams of the magnetic iron powder obtained in Example 1 were charged together with 10 gr of a 25% methyl ethyl ketone solution of thermoplastic polyurethane resin, 38 gr of methyl ethyl ketone and 0.05 gr of a silicon-base additive in a vessel made of stainless steel. Using alumina-made beads as a dispersing medium, the above-proportioned mixture was treated for 8 hours in a paint conditioner, thereby forming a mill base. This mill base was thereafter added with 10 gr of the methyl ethyl ketone solution of the polyurethane resin, followed by an addition of methyl ethyl ketone so as to adjust its viscosity and thus obtain a magnetic coating formulation. This coating formulation was then applied onto a reinforced polyethylene terephthalate film of 12 um thick by means of a blade coater to give a dry coat thickness of about 4 um. The thus-coated film was thereafter passed through a magnetic field to orient the magnetic particles. The magnetic coating layer was dried by hot air and then rendered smoother by passing it through calender rolls, thereby obtaining a sample tape for evaluation. The magnetic tape showed extremely good magnetic properties, namely Hc=1305 Oe, Br/Bs=0.83 and orientation=2.5. The high Br/Bs ratio and high orientation indicate that the acicular crystallinity of the starting α-FeOOH had been retained until reduced to iron and the resulting iron powder was excellent in dispersability.

What is claimed is:

1. Process for producing ferromagnetic iron powder by heating a metal oxyhydroxide or oxide containing iron as its principal metallic element in a reducing atmosphere so as to reduce said metal oxyhydroxide or oxide, comprising the following consecutive steps:

(a) mixing said metal oxyhydroxide or oxide with zinc borate at a B/Fe atomic weight ratio of 0.05/100 to 50 5/100 without dissolving said borate, so that said borate is dispersed in said metal oxyhydroxide or oxide;

(b) heating mixture obtained from step (a) to a temperature of 350° to 500° C. in a non-reducing atmosphere; and (c) reducing the heated mixture from step (b) at a temperature of 200° to 450° C. while keeping said heated mixture in contact with hydrogen gas.

2. The process as claimed in claim 1 wherein said metal oxyhydroxide or oxide is acicular α-FeOOH or $\alpha Fe_2O_3$.

3. The process as claimed in claim 1 wherein mixing and dispersing step (a) is carried out in the absence of any dispersing medium.

4. The process as claimed in claim 1 wherein mixing and dispersing step (a) is carried out in the presence of a dispersing medium.

5. The process as claimed in claim 4 wherein the solubility of zinc borate in said dispersing medium is 1 weight percent or lower.

6. The process as claimed in claim 1 wherein the B/Fe atomic weight ratio ranges from 0.2/100 to 2/100.

7. The process as claimed in claim 1 wherein α-FeOOH and zinc borate are mixed at a B/Fe atomic weight ratio of 0.2/100 to 2/100 using water of low electric conductivity as a dispersing medium so as to disperse zinc borate in FeOOH, the resultant mixture is heated within the temperature range of 350° to 500° C. in the non-reducing atmosphere, and the heated mixture is then reduced at a temperature of 200° to 450° C.

* * * * *